US007275465B2

(12) United States Patent
Maznicki

(10) Patent No.: US 7,275,465 B2
(45) Date of Patent: Oct. 2, 2007

(54) NON-MARRING TOOLS

(75) Inventor: Peter Maznicki, Somers, CT (US)

(73) Assignee: ProTec Tools, LLC, Westport, CT (US)

( * ) Notice: Subject to any disclaimer, the term of this patent is extended or adjusted under 35 U.S.C. 154(b) by 76 days.

(21) Appl. No.: 11/031,139

(22) Filed: Jan. 7, 2005

(65) Prior Publication Data

US 2005/0193877 A1 Sep. 8, 2005

Related U.S. Application Data

(60) Provisional application No. 60/534,902, filed on Jan. 8, 2004.

(51) Int. Cl.

| | |
|---|---|
| ***B25B 13/48*** | (2006.01) |
| ***B25B 13/00*** | (2006.01) |
| ***B25B 23/00*** | (2006.01) |
| *B25B 13/06* | (2006.01) |

(52) U.S. Cl. ..... 81/436; 81/124.6; 81/121.1

(58) Field of Classification Search ..... 81/900, 81/124.6, 121.1, 436

See application file for complete search history.

(56) References Cited

U.S. PATENT DOCUMENTS

| | | | | |
|---|---|---|---|---|
| 3,868,874 A | | 3/1975 | Olashaw | |
| 4,286,600 A | * | 9/1981 | Judickas | 606/188 |
| 4,790,573 A | * | 12/1988 | Cardozo | 285/330 |
| 5,182,973 A | * | 2/1993 | Martindell | 81/429 |
| 5,970,826 A | * | 10/1999 | Iwinski et al. | 81/124.6 |
| 6,126,882 A | * | 10/2000 | Iwinski et al. | 264/261 |
| 6,962,098 B2 | * | 11/2005 | Eggert et al. | 81/124.6 |
| 2002/0033079 A1 | | 3/2002 | Zurbuchen et al. | |
| 2003/0192409 A1 | | 10/2003 | Wallace | |
| 2004/0129388 A1 | * | 7/2004 | Brazil | 157/13 |

* cited by examiner

*Primary Examiner*—Lee D. Wilson
*Assistant Examiner*—Alvin J. Grant
(74) *Attorney, Agent, or Firm*—Jonathan Tyler; Brandon N. Sklar; Kaye Scholer LLP

(57) ABSTRACT

In one embodiment, an enhanced hex key comprises a hex key composed of a first material (e.g., a metal such as steel) and non-marring, protective sleeve composed of a second material fitted onto the hex key bit portion of the hex key. In one embodiment, the sleeve may be comprised of a thermoset material such as, preferably, a glass reinforced thermoset plastic. The sleeve has a hexagonally-shaped inner surface that fits onto the hex key bit, and a hexagonally-shaped outer surface that fits, e.g., into fasteners of a specified size. The sleeve may be connected to the hex key bit by an adhesive. The sleeve may additionally be connected to the hex key bit using a screw such as, e.g., a set screw. Alternatively, the sleeve may be pinned to the hex key bit using a pin such as, e.g., a dowel pin. Tools with non-marring surfaces are also disclosed.

11 Claims, 4 Drawing Sheets

NON-MARRING TOOLS

This application claims the benefit under 35 U.S.C. § 119(e), of U.S. Provisional Application No. 60/534,902, filed Jan. 8, 2004, which is incorporated by reference herein.

FIELD OF THE INVENTION

The invention relates to tools used for assembling and connecting apparatus components together, and more particularly to tools having a sleeve, which are designed to have high torque value while reducing the likelihood of damage to hardware fasteners or components in communication thereof when torque is applied.

BACKGROUND OF THE INVENTION

Metallic hex keys and other tools are commonly used as an effective tool for assembling and connecting apparatus components to one another. Typically, a hex key is a solid hexagonal bar that fits into the hexagonal hole of a hex key bolt or other such fastener. Hex keys can be used with a variety of fasteners including, for example, socket head cap screws, flat head cap screws, button head cap screws, etc. A hex key comprises a body portion, which may provide a surface for gripping, for example. The body portion comprises a male portion, which is received within the female portion of a fastener. The male portion is sometimes referred to as a "bit" or "hex key bit." Many other tools similarly comprise a body portion and a bit, or male portion, receivable within the female portion of a fastener. For example, the tip of a screwdriver may be considered a bit receivable within the slot on a screwhead, which in turn may be referred to as the female portion of the screw.

The use of a hex key, through the application of torque, can damage or mar the fasteners and components that are being assembled. For example, the fastener may be chipped, the corners within the female fasteners may be stripped, or the paint or coating can be damaged or scraped off the surface of the fastener. Additionally, the component itself may be scraped or scratched as the hex key twists against its surface.

Damage is common when a hex key is applied to a plated (e.g., chrome-plated, cadmium-plated, anodize-plated, powder-coated, painted, etc.) fastener. Damage to fasteners can result in contamination, or rust, which can be unsightly and/or unacceptable for certain uses. Plated fasteners are used in many industries including the aerospace, aircraft, automotive, marine, motorcycle, and home furnishing industries. Individuals and companies in these industries experience significant expense, in both time and in money, due to the damage resulting from the application of metallic hex key tools to plated fasteners.

A variety of approaches are commonly used in an attempt to prevent hex keys from causing damage to fasteners and components. For example, one approach used is to place a material such as scotch tape or masking tape on the contact portion of the hex key wrench to prevent the metallic surface of the hex key wrench from contacting the surface of the fastener.

This type of approach can cause additional problems. Taping either the fastener or a hex key can be time-consuming. In addition, tape frequently tears, and may prevent the tool from fitting properly into the fastener or may no longer provide the desired protection to the fastener. Most importantly, when the fastener is required to reach a specified torque load, the tape or cloth may produce false torque results.

SUMMARY OF THE INVENTION

Embodiments of the invention overcome the disadvantages of the prior art by providing an enhanced hex key having high torque value while reducing the likelihood of damage to hardware fasteners or components to which the enhanced hex key is applied. Accordingly, in accordance with an embodiment of the invention, an apparatus for applying torque to a fastener is provided. In one embodiment, an enhanced hex key comprises a hex key, which comprises a first material (e.g., a metal such as steel) and a protective sleeve comprising a second, non-marring material connected to the hex key bit portion of the hex key. In one example, the enhanced hex key comprises a body portion including a male bit portion, and a non-marring sleeve connected to the body portion by a connecting member.

The sleeve may comprise a thermoset plastic and has a predetermined shape. Preferably, the sleeve comprises a glass reinforced thermoset plastic. The thermoset plastic may comprise woven or molded, glass-reinforced thermoset plastic. In one example, the sleeve has a hexagonally-shaped inner surface that is connected to the hex key bit, and a hexagonally-shaped outer surface that fits, e.g., into fasteners of a specified size. The sleeve may be connected to the hex key bit by an adhesive. The sleeve may be additionally connected to the hex key bit using a screw such as a set screw. Alternatively, the sleeve may be pinned to the hex key bit using a pin such as a dowel pin.

Protective sleeves may also be connected to key bits having other shapes, such as double hexagon, square, and double square keys. In yet other embodiments, sleeves or coatings may be connected to other tools including, e.g., pipe wrenches, pliers, vise grips, torque bits, Phillips head drivers, screw drivers, etc.

In another embodiment of the invention, a method for manufacturing an enhanced hex key is provided. Accordingly, a sleeve comprising a thermoset material, such as a glass reinforced thermoset plastic, is formed. The sleeve further comprises a hole and an external surface. An adhesive is placed on the surface of the bit portion of a tool, such as hex key. The sleeve is positioned such that the bit portion of the tool is received within the hole. The external surface of the sleeve is shaped to provide a desired shape to the external surface, and the sleeve is connected to the bit portion of the tool by a connecting member such as a screw.

In an alternative embodiment, an apparatus for applying force is provided, comprising a body portion having an external surface to apply force, and a preformed member comprising a non-marring material, and a predetermined shape, attached to the body portion over the external surface. The non-marring material may be a thermoset plastic material, such as a glass-reinforced thermoplastic.

BRIEF DESCRIPTION OF THE DRAWING

Further objects, features and advantages of the invention will become apparent from the following detailed description taken in conjunction with the accompanying drawing showing illustrative embodiments of the invention, in which.

DETAILED DESCRIPTION

Figure 1:
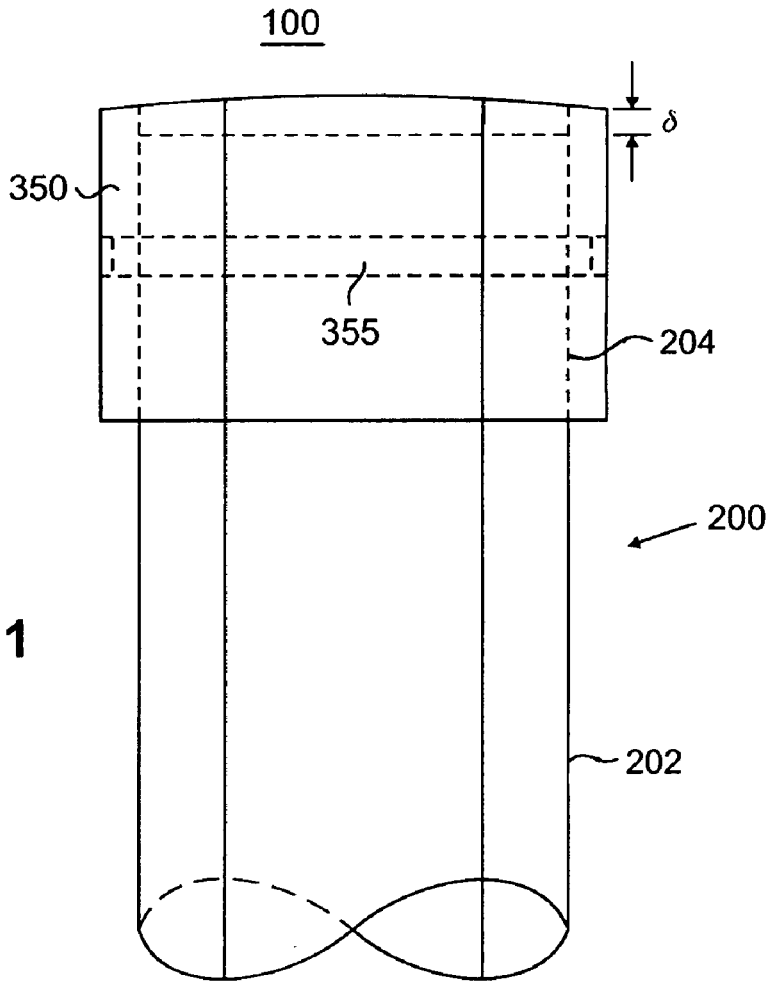
FIG. 1 illustrates schematically an enhanced hex key, in accordance with one embodiment of the invention.

FIG. 1 illustrates schematically an enhanced hex key 100, in accordance with an embodiment of the invention. In this embodiment, an enhanced hex key 100 comprises a protective sleeve 350 attached to hex key 200. The protective sleeve 350 is not marred by the application of torque by the hex key.

Hex key 200 comprises a body portion 202, which comprises a male bit portion 204. Hex key 200 may comprise a metal, e.g., steel. Sleeve 350 comprises a thermoset plastic that is cured (set) by a chemical reaction such that it remains hard, even when reheated. Sleeve 350 may comprise a glass reinforced thermoset material such as, e.g., a glass or fiberglass reinforced plastic. In one example, sleeve 350 may comprise a laminated plastic chosen from the family of garolite, which is a phenolic material. For example, sleeve 350 may comprise the material known as G-10/FR4 Garolite, available from the McMaster-Carr Supply Co., located in Elmhurst, Ill. This material consists of continuous, woven glass fabric laminated with epoxy resin formed under pressure and heat. G-10/FR4 Garolite is said to exhibit excellent tensile strength (up to 10,000 psi), electrical insulation properties (500 volts per 0.001 inch thickness), and impact strength (5 foot pounds of energy per inch of thickness, under normal conditions). This material is also said to function well between 0° and 284° Fahrenheit. G-10/FR4 Garolite is also lightweight, and is said to be resistant to heat, moisture, chemicals, oil, corrosive solutions, acids alkalies, and solvents. Alternatively, sleeve 350 may comprise a polyphenylene sulfide material, such as the material known as GS-40, available from Toson Corp. located in Minato-ku, Tokyo, Japan. GS-40 is a molded plastic, and is said to be 40% glass filled. GS-30, which is 30% glass filled, or GS-20, which is 20% glass filled, may also be used where less torque is needed.

Sleeve 350 may be preformed and have a predetermined shape. In the illustrative embodiment, sleeve 350 is a hexagonal cylinder and is open at both ends. Both the inner and outer surfaces of sleeve 350 are hexagonal in shape. The inner surface is connected to the bit portion 204 of hex key 200.

It should be noted that, in this illustrative embodiment, sleeve 350 extends slightly past the end of the bit portion 204 of hex key 200. The distance δ by which sleeve 350 extends past the end of hex key 200 may vary but should be sufficient to ensure that the end of the bit portion 204 does not come into contact with the surface of a female fastener in which it is used. For example, sleeve 350 may extend past the end of the bit portion 204 a distance of 0.015 inches.

The sleeve 350 is connected to the bit portion 204 of hex key 200 with an adhesive or a similar bonding agent. For example, sleeve 350 may be connected to the bit portion 204 with Loctite 41145 5000 CPS Viscosity Clear Adhesive, available from the McMaster-Carr Supply Co., described above.

Additionally, sleeve 350 may be connected to the bit portion 204 of hex key 200 by a connecting member. In the illustrative example, sleeve 350 is screwed to the bit portion 204 by a set screw 355. Set screw 355 extends through sleeve 350 and hex key 200; however, the ends of set screw 355 are recessed relative to the outer surface of sleeve 350. Other types of screws may be used, as well. Set screw 355 may be removable, making it possible to replace sleeve 350 if desired. Alternatively, sleeve 350 may be pinned to hex key 200 by, e.g., a dowel pin. The pin may also be removable. In another example, sleeve 350 is glued to hex key 200 but is not screwed or pinned.

Figure 2A:
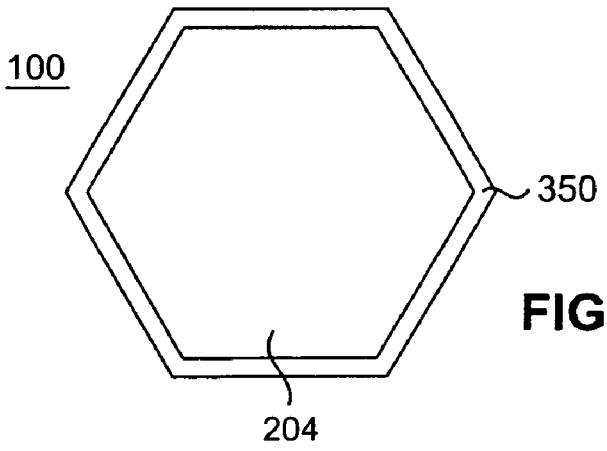
FIG. 2A shows a top view of the enhanced hex key of FIG. 1.

FIG. 2A shows a top view of enhanced hex key 100, in accordance with an embodiment of the invention. Because sleeve 350 is open at both ends, the surface at the end of the bit portion 204 of hex key 200 is visible, and is surrounded by sleeve 350.

Because of the addition of sleeve 350, the width of enhanced hex key 100 is greater than the width of hex key 200 alone. Specifically, the width of enhanced hex key 100 is equal to the sum of (1) the width of hex key 200 and (2) twice the wall thickness of sleeve 350. In one embodiment, the wall thickness of sleeve 350 is selected to transform a respective hex key having a first standard size into a hex key with a second standard size. For example, in an embodiment, the following relationships may be achieved by varying the wall thickness of sleeve 350:

| Original Hex Key Size (inches) | Wall Thickness of Sleeve (inches) | Size of Enhanced Hex Key (inches) |
|---|---|---|
| 3/32 | 3/64 | 3/16 |
| 1/8 | 3/64 | 7/32 |
| 5/32 | 3/64 | 1/4 |
| 7/32 | 3/64 | 5/16 |
| 1/4 | 1/16 | 3/8 |

Accordingly, a hex key having a standard size of 3/32 inches may be fitted with a sleeve of wall thickness 3/64 inches to produce an enhanced hex key having a standard size of 3/16 inches, for example.

The outer surface of sleeve 350 may conform to the ANSI/ASME B18.3-1986 standard for socket head cap screws. This standard is well known and used in many industries.

Figure 2B:
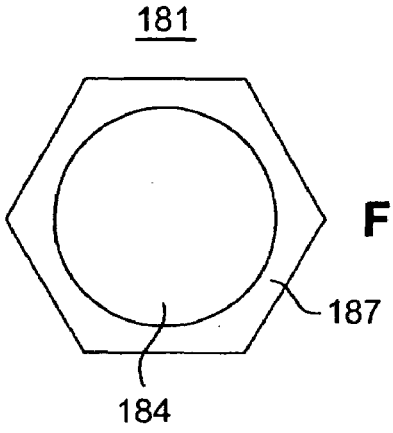
FIG. 2B shows a top view of an enhanced hex key, in accordance with an alternative embodiment of the invention.

FIG. 2B shows a top view of an enhanced hex key 181, in accordance with an alternative embodiment of the invention. Bit portion 184 represents a round bit portion of a tool, and may comprise a metal such as, e.g., steel. As above, the sleeve 187 may comprise a thermoset material such as, e.g., a glass reinforced thermoset material. For example, sleeve 187 may comprise G-10/FR-4 Garolite, or, alternatively, GS-40, discussed above. In this example, the outer surface of bit portion 184 has a round shape. The inner surface of sleeve 187 also has a round shape; however, the outer surface of sleeve 187 has a hexagonal shape.

Figure 3:
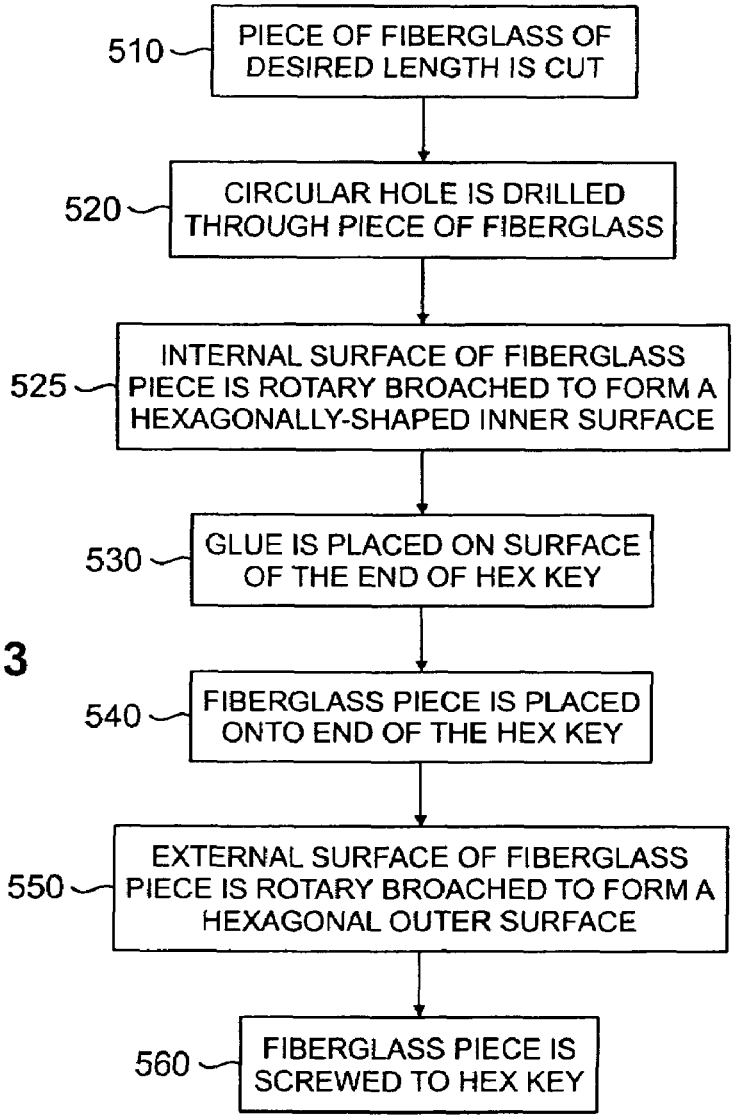
FIG. 3 is a flowchart of an example of a method for manufacturing an enhanced hex key, in accordance with one embodiment of the invention.

FIG. 3 is a flowchart depicting a method for manufacturing an enhanced hex key, in accordance with an aspect of the invention. The process starts with a standard hex key, e.g., a steel hex key, and a rod of a selected thermoset material. In this example, a rod of fiberglass is used; however, other materials may be used. At step 510, a piece of fiberglass of a desired length is cut from the rod. In one embodiment, the piece of fiberglass is cut to a length equal to the depth of a selected fastener (e.g., the depth of a cap screw). At step 520, a circular hole is drilled through the piece of fiberglass, along the axis. At step 525, the internal surface of the circular hole is broached to form a hexagonally-shaped hole. In one embodiment, rotary broaching is used. At step 530, an adhesive (e.g., glue) is placed on the surface of the bit portion of the hex key. At step 540, the fiberglass piece is placed onto the end of the hex key. At step 550, the external surface of the fiberglass piece is broached to form a hexagonal outer surface. In one embodiment, rotary broaching is used. In an alternative embodiment, step 550 may be accomplished by milling the outer surface of the fiberglass piece. At step 560, the fiberglass piece is connected to the hex key using a connecting member such as, e.g., a set screw. In an alternative embodiment, the fiberglass piece may be pinned to the hex key, using, e.g., a dowel pin. In yet other embodiments, other types of screws, pins, etc., may be used.

The hexagon formed by the inner surface of the sleeve and the hexagon formed by the outer surface may be aligned, i.e., the inner and outer walls of the sleeve are parallel or substantially parallel. This may be achieved by first attaching the sleeve to the hex key bit and subsequently broaching the external surface of the sleeve, as outlined in FIG. 3.

In an alternative embodiment, an enhanced hex key such as that shown in FIG. 2B may be manufactured. A piece of thermoset material of a desired length is cut from a rod. The piece of fiberglass is cut to a desired length, and a circular hole is drilled through the piece of fiberglass, along the axis. An adhesive (e.g., glue) is placed on the surface of the bit portion of a tool. The bit portion has a round shape, and may be made of, e.g., steel. The fiberglass piece is placed onto the end of the bit portion. The external surface of the fiberglass piece is broached to form a hexagonal outer surface, and the fiberglass piece is connected to the bit portion using, e.g., a set screw.

In yet another alternative embodiment, a piece of molded plastic having a hole with a desired internal shape may be used as a sleeve. The molded plastic sleeve may comprise, e.g., GS-40, discussed above. An adhesive (e.g., glue) is placed on the surface of the bit portion of a hex key. The molded plastic sleeve is placed onto the bit portion of the hex key. The external surface of the sleeve is broached to form a hexagonal outer surface, and the sleeve is connected to the hex key using, e.g., a set screw. Alternatively, a molded plastic sleeve having a hole with a rounded internal shape may be attached by adhesive to the end of a round bit portion; the external surface of the sleeve may then be shaped to provide a desired external shape.

Figure 4:
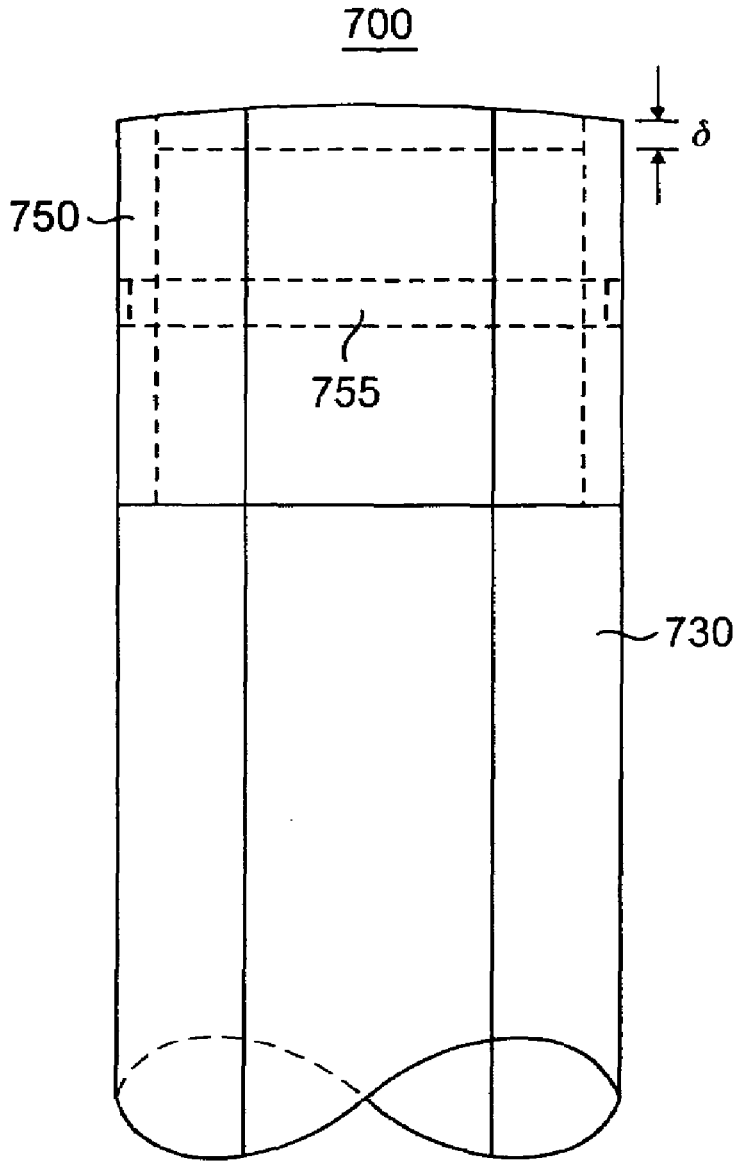
FIG. 4 illustrates an enhanced hex key, in accordance with an alternative embodiment of the invention.

FIG. 4 illustrates an enhanced hex key 700, in accordance with an alternative embodiment of the invention. In this illustrative embodiment, enhanced hex key 700 comprises hex key 730 having an original standard size of, say, G, and sleeve 750. Sleeve 750 may comprise a material such as, e.g., fiberglass, or, alternatively, molded plastic. The thickness of hex key 730 is reduced before sleeve 750 is attached. For example, this may be achieved by milling the hex key bit portion of hex key 730. Sleeve 750 is then connected to the bit portion of hex key 730 to produce enhanced hex key 700 having the standard size G originally associated with hex key 730. By way of example, a ⅜-inch hex key (G=⅜ inch) may first be reduced to a ¼-inch hex key. A sleeve having a wall thickness of 1/16-inch is then attached in the manner described above, to produce an enhanced hex key with the original ⅜-inch standard size. Sleeve 750 extends a distance $\delta$ past the end of hex key 730. Sleeve 750 is additionally connected to hex key 730 using a set screw 755. Referring to FIG. 4, set screw 755 extends through sleeve 750 and through hex key 730, but the ends of set screw 775 are recessed relative to the outer surface of sleeve 750. Other types of screws may be employed as well. Sleeve 750 may also be pinned to hex key using, e.g., a dowel pin. Sleeve 750 may also be glued to hex key 730 but not screwed or pinned.

The material used to form sleeves 350 and 750 may be used to form protective sleeves for key bits of other shapes. For example, in alternative embodiments, protective sleeves may be formed for key bits with various polygonal shapes including, without limitation, double hexagon, square, double square, etc. Such sleeves may comprise, e.g., fiberglass, or, alternatively, molded plastic.

Figure 5:
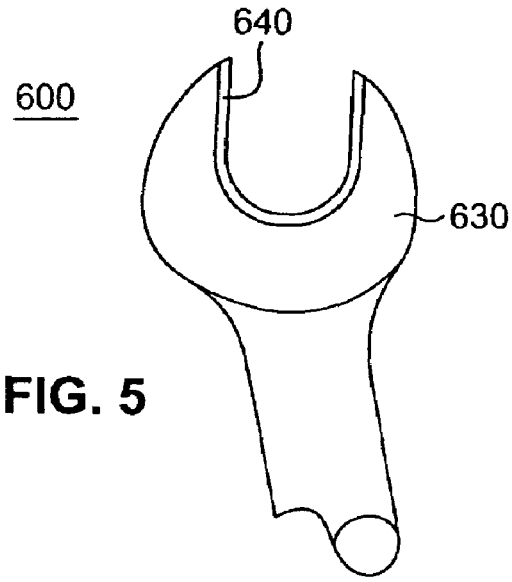
FIG. 5 illustrates an enhanced wrench, in accordance with an embodiment of the invention.

The material used to form sleeve 350 may be used in a similar manner in combination with a variety of other tools used to apply force and/or torque. For example, a sleeve comprising a thermoset material may be connected to the surface of an open-end wrench. This configuration results in an enhanced wrench that has high torque value while reducing the likelihood of damaging fasteners or components to which the enhanced wrench is applied. FIG. 5 illustrates an enhanced wrench 600 comprising an open-end wrench 630 and a protective material, such as a fiberglass sleeve 640, in accordance with an embodiment of the invention. Sleeve 640 covers the entire surface within the mouth of open-end wrench 630. The open-end wrench 630 may comprise a metal, e.g., steel. Sleeve 640 may comprise a material such as, e.g., G-10/FR4 Garolite.

Sleeve 640 may be connected to open-end wrench 630 with an adhesive (e.g., glue) or a similar bonding agent. For example, sleeve 640 may be connected to open-end wrench 630 with Loctite 41145 5000 CPS Viscosity Clear Adhesive, discussed above.

Figure 6:
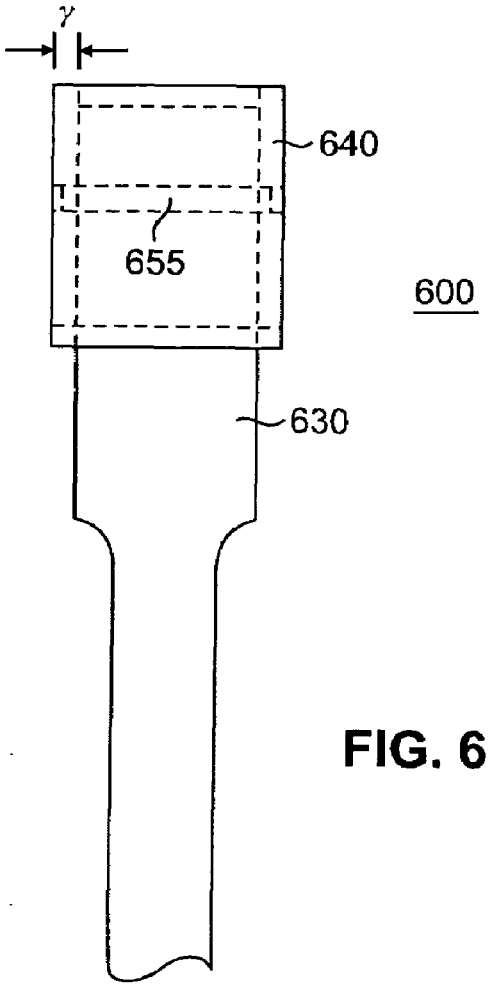
FIG. 6 shows an internal face of the enhanced wrench of FIG. 5.

FIG. 6 shows an internally-facing surface of the mouth of enhanced wrench 600. Sleeve 640 covers the entire internal surface of the mouth of wrench 630, and extends a small distance $\gamma$ beyond the edges of the surface. In addition, a set screw 655 extends through sleeve 640 and wrench 630. Alternatively, sleeve 640 may be pinned to wrench 630 using, e.g., a dowel pin.

A removable covering, such as a sleeve, may be placed over all or a part of the open-end portion of open-end wrench 630. The removable sleeve may comprise a material such as, e.g., G-10/FR4 Garolite, or, alternatively, molded plastic. Such a removable covering is not permanently attached and therefore has the advantage of being able to be replaced. For example, in one embodiment, several sleeves of various sizes may be used for different settings of an adjustable wrench.

The principles described herein can be advantageously used with other tools as well. For example, protective sleeves or coverings may be utilized with, e.g., pipe wrenches, pliers, vise grips, torque bits, Phillips head drivers, screw drivers, etc. This list is for illustrative purposes and should not be viewed as limiting in any way.

The foregoing merely illustrates the principles of the invention. It will thus be appreciated that those skilled in the art will be able to devise numerous other arrangements which embody the principles of the invention and are thus within its spirit and scope, which is defined by the claims below.

The invention claimed is:

1. A method of manufacturing, comprising:

forming a thermoset material into a sleeve, the sleeve having a hole and an external surface;

placing an adhesive on a surface of a bit portion of a tool;

positioning the sleeve and the tool such that the bit portion is received within the hole;

shaping the external surface of the sleeve to provide a desired shape to the external surface; and connecting the sleeve to the bit portion by using a connecting member.

2. The method of claim 1, comprising shaping the external surface of the sleeve by broaching.

3. The method of claim 1, wherein the desired shape is hexagonal.

4. The method of claim 1, further comprising providing a second desired shape to an internal surface of the hole.

5. The method of claim 4, comprising providing the second desired shape to the internal surface by broaching.

6. The method of claim 4, comprising providing the second desired shape by rotary broaching.

7. The method of claim 1, wherein the connecting member comprises a screw.

8. The method of claim 1, wherein the connecting member comprises a pin.

9. The method of claim 1, wherein the tool is chosen from the group consisting of a pipe wrench, pliers, a vise grip, a torque bit, a Phillips head driver, and a screw driver.

10. The method of claim 1, wherein the thermoset material comprises a glass reinforced material.

11. The method of claim 10, wherein the glass reinforced material comprises fiberglass.

* * * * *